United States Patent [19]

Birnbreier et al.

[11] Patent Number: 4,530,852

[45] Date of Patent: Jul. 23, 1985

[54] METHOD FOR PRODUCING A THIN FILM RESISTOR

[75] Inventors: Hermann Birnbreier, Sandhausen; Helmut Haas, Leimen, both of Fed. Rep. of Germany

[73] Assignee: Brown, Boveri & CIE AG, Mannheim-Käfertal, Fed. Rep. of Germany

[21] Appl. No.: 570,743

[22] Filed: Jan. 16, 1984

[30] Foreign Application Priority Data

Jan. 20, 1983 [DE] Fed. Rep. of Germany ..... 3301665

[51] Int. Cl.[3] ..... B05D 5/12

[52] U.S. Cl. ..... 427/102; 427/103; 427/383.3; 338/308

[58] Field of Search ..... 427/102, 103, 383.3; 338/307, 308

[56] References Cited

U.S. PATENT DOCUMENTS

| | | | |
|---|---|---|---|
| 4,007,063 | 2/1977 | Yasuda | 427/103 |
| 4,019,168 | 4/1977 | Collins | 427/103 |
| 4,021,277 | 5/1977 | Shirn et al. | 427/103 |
| 4,145,470 | 3/1979 | Matsuura | 338/308 |
| 4,194,174 | 3/1980 | DeLise | 427/103 |

*Primary Examiner*—Richard Bueker

*Attorney, Agent, or Firm*—Herbert L. Lerner; Laurence A. Greenberg

[57] ABSTRACT

Method for producing a thin film resistor by vapor deposition or cathode sputtering techniques, wherein part of the resistance area of the film is covered by an electrically insulating layer which prevents oxygen diffusion onto the resistance material and causes a decrease of the resistance during aging, while the rest of the resistance area remains free.

9 Claims, 4 Drawing Figures

FIG. 1(a)
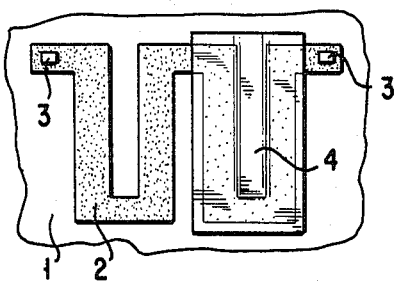
FIG. 1(b)
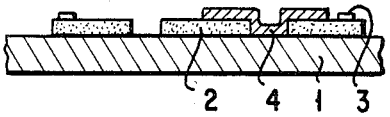
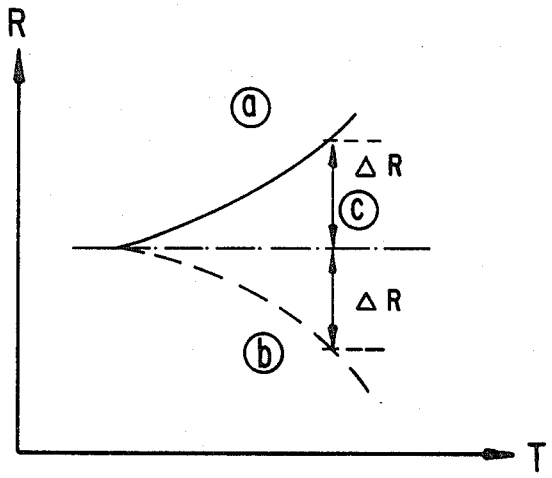
FIG. 2
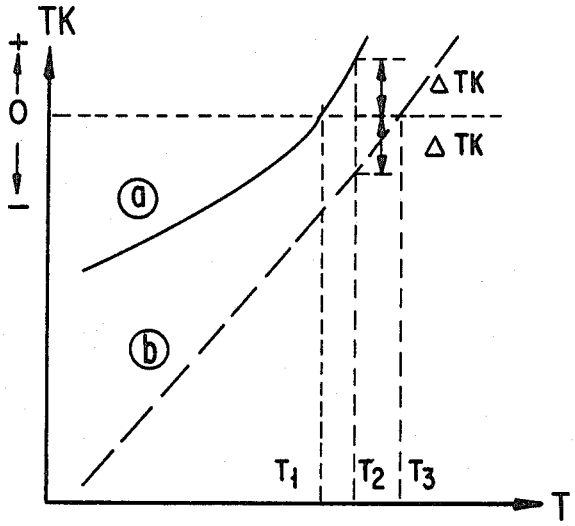
FIG. 3

METHOD FOR PRODUCING A THIN FILM RESISTOR

BACKGROUND OF THE INVENTION

1. Field of the Invention

The invention relates to a method for producing a thin film resistor by vapor deposition or cathode sputtering techniques.

2. Description of the Prior Art

A method for producing a thin film resistor is disclosed in Moeschwitzer/Lunze, "Halbleiterelektronik" (semiconductor electronics), Huethig-Verlag, Heidelberg, 1980, pages 433 to 437. Resistors in thin film technology can generally be produced by vapor deposition or cathode sputtering. NiCr is the preferred resistance material. For adjusting a small temperature coefficient, the resistors are annealed, i.e., thermal post-treated. NiCr resistors annealed in air have advantageously a large long-term constant and little temperature drift.

However, it is a disadvantage that the value of the electric resistance of the thin film resistor is increased by the annealing to an extent which is by no means negligible. Therefore, it does not make sense to measure the electric resistance immediately after the vapor deposition or the cathode sputtering ("in situ" measurement).

SUMMARY OF THE INVENTION

An object of the invention is to provide a method for producing a thin film resistor of the type mentioned at the outset which ensures constancy of the electric resistance in long-term operation and with annealing.

With the foregoing and other objects in view, there is provided in accordance with the invention a method of treating a film resistor with an exposed resistance area produced by vapor deposition or cathode sputtering techniques, to compensate for an increase of the electric resistance during aging, which comprises covering part of the resistance area of the resistor by an electrically insulating layer which prevents oxygen diffusion into the covered area and causes a decrease in the resistance of the resistor during aging, with the remaining resistance area free of the electrically insulating layer.

Other features which are considered as characteristic for the invention are set forth in the appended claims.

Although the invention is illustrated and described herein as embodied in a method for producing a thin film resistor, it is nevertheless not intended to be limited to the details shown, since various modification may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings in which:

FIG. 1 shows a thin film resistor in a top view and a cross section;

FIG. 2 shows the dependence of the electric resistance on the aging temperature, and FIG. 3 shows the dependence of the temperature coefficient on the aging temperature.

DETAILED DESCRIPTION OF THE INVENTION

In thin film resistors produced by vapor deposition or cathode sputtering techniques, annealing is generally required for adjusting a small temperature coefficient. In order to compensate for an increase of the electric resistance during annealing and in long-term operation, part of the resistance area is covered with an electrically insulating layer, preferably of glass, $Al_2O_3$ or a ceramic containing $Al_2O_3$, which prevents oxygen diffusion onto the resistance material, while the rest of the resistance area is chosen in a proportion to the covered area so that the total value of the electric resistance before and after the anneal remains constant. The compensated thin film resistors can generally be used in thin film and hybrid technology.

The advantages attainable with the invention are in particular that a reliable measurement of the electric resistance of the thin film resistor can be made immediately during the vapor deposition or cathode sputtering, since it does not change subsequently either in long-term operation or in annealing.

The invention will be explained in the following with the aid of the embodiment shown in the drawings.

In FIG. 1, a thin film resistor is shown in a top view and a cross section. A resistor 2 material, for instance NiCr is applied in meander-shaped paths by means of vapor deposition or cathode sputtering techniques to a substrate 1 material, for instance, glass or $Al_2O_3$. The terminals of the resistor 2 are formed by metal contacts 3.

In the embodiment example, part of the resistor 2 is covered up by an electrically insulating cover layer 4 material, for instance glass, $Al_2O_3$, or ceramic containing $Al_2O_3$, for example mullite, while the remaining part of the resistor remains free. The cover layer 4 prevents oxygen diffusion onto the resistance material. In principle, the ratio of the covered and uncovered resistor areas can be chosen at will and is preferably adjusted so that the total value of the electric resistance remains constant during a subsequent anneal of the thin film resistor or in long-term operation, as will be further explained in the following.

After the cover layer is applied, the thin film resistor can be subjected to an annealing process. In this connection, FIG. 2 shows how the electric resistance R changes as a function of the aging temperature T (annealing temperature). An annealing process of about 5 hours duration in air and with an aging temperature of 200° to 400° C. is assumed.

The solid line a shows the resistance change of the uncovered part of the resistor after the annealing process. Due to oxygen diffusion, the electric resistance R increases considerably with increasing aging temperature T. The dashed line b shows the resistance change of the resistance part covered by the layer 4. The electric resistance R decreases considerably with increasing aging temperature T.

The ratio between the covered and not covered resistance area is chosen so that the total value of the electric resistance before and after the annealing process, and independently of the aging temperature, remains constant, i.e. the dashed-dotted line c according to FIG. 2 is obtained. If the ratio between the covered and uncovered resistor area is chosen correctly, the electric resistance of the uncovered part of the resistor increases after the annealing process by the value $\Delta R$. At the same time, the electric resistance of the covered part of the resistor is reduced by the same amount $\Delta R$, so that the total electric resistance of the thin film resistor does not change before and after the annealing.

The partial covering-up of the thin film resistor is advantageous not only if the resistor is subjected to an annealing process, but also if the thin film resistor is not annealed, because it retains its electric resistance in long-term operation (annealing=fast aging). The reason for this is that the resistance changes of the covered and uncovered parts of the resistor which occur in long-term operation likewise compensate each other.

For adjusting a small temperature coefficient, however, annealing is generally necessary. In this connection the dependence of the temperature coefficient TK on the aging temperature T is shown in FIG. 3. The solid line a shows the change of the temperature coefficient of the uncovered part of the resistor. The uncovered part of the resistor first exhibits a negative temperature coefficient at the lower temperature. The temperature coefficient reaches the 0 value at the aging temperature $T=T_1$, and then becomes positive at an aging temperature exceeding the value $T_1$.

The dashed line b shows the temperature coefficient change of the covered part of the resistor. Prior to the annealing, the temperature coefficient of the covered part of the resistor is likewise negative. At the aging temperature $T=T_3$, the temperature coefficient reaches 0 value, the value $T_3$ being larger than the value $T_1$. At an aging temperature exceeding the value $T_3$, the temperature coefficient of the covered-up part of the resistor becomes positive.

By a correct choice of the annealing temperature of the annealing process it is possible to obtain an overall temperature coefficient of the thin film resistor having 0 value. To this end, the aging temperature T must have a value $T_2$ which is between the value $T_1$ and $T_3$. At the aging temperature $T_2$, the uncovered part of the resistor reaches a positive temperature coefficient $+\Delta TK$ and the covered part of the resistor exhibits a negative temperature coefficient $-\Delta TK$ of the same size. If, in simplification, a distribution between the covered and uncovered part of the resistor of 50% is assumed, compensation of the negative and positive temperature coefficient is obtained if the aging temperature is chosen as $T_2$, and thereby, an overall temperature coefficient of 0 value.

The term "aging" as used in the claims shall mean annealing or long-term operation, or both.

The thin film resistors prepared in accordance with the method of the invention can generally be used in thin film technology and in hybrid technology.

The foregoing is a description corresponding, in substance, to German application P No. 33 01 665.8, dated Jan. 20, 1983, international priority of which is being claimed for the instant application, and which is hereby made part of this application. Any material discrepancies between the foregoing specification and the specification of the aforementioned corresponding German application are to be resolved in favor of the latter.

We claim:

1. A method of treating a film resistor with an exposed resistance area produced by vapor deposition or cathode sputtering techniques, to produce a thin film resistor which remains constant in electric resistance during long-term operation, which comprises covering part of the resistance area of the resistor by an electrically insulating layer which prevents oxygen diffusion into the covered area and causes a decrease in the resistance of the resistor during aging, with the remaining resistance area free of any layer which prevents oxygen diffusion into the remaining resistance area, proportioning the covered resistance area to the uncovered resistance area to cause the overall value of the electric resistance to remain constant during long-term operation.

2. A method of treating a film resistor with an exposed resistance area produced by vapor deposition or cathode sputtering techniques, to produce a thin film resistor which including annealing remains constant in electric resistance before and during annealing and during long-term operation after an annealing, which comprises annealing by heating the film resistor to adjust the temperature coefficient of resistance of the thin film resistor to a desired value, prior to said annealing covering part of the resistance area of the resistor by an electrically insulating layer which prevents oxygen diffusion into the covered area and causes a decrease in the resistance of the resistor during aging, with the remaining resistance area free of any layer which prevents oxygen diffusion into the remaining resistance area, proportioning the covered resistance area to the uncovered resistance area to cause the overall value of the electric resistance to remain constant during long-term operation including before and during the subsequent annealing of the resistor, said uncovered remaining resistance area remaining free of any layer which prevents oxygen diffusion during heat treatment of said subsequent annealing.

3. Method according to claim 2, wherein the annealing is performed at a temperature, at which the overall temperature coefficient of the resistor becomes 0.

4. Method according to claim 1, wherein a metal oxide is used as the cover layer.

5. Method according to claim 2, wherein a metal oxide is used as the cover layer.

6. Method according to claim 1, wherein $Al_2O_3$ or ceramic containing $Al_2O_3$ is used as the cover layer.

7. Method according to claim 2, wherein $Al_2O_3$ or ceramic containing $Al_2O_3$ is used as the cover layer.

8. Method according to claim 1, wherein glass is used as the cover layer.

9. Method according to claim 2, wherein glass is used as the cover layer.

* * * * *